US005310445A

United States Patent [19]

Tucker

[11] Patent Number: 5,310,445

[45] Date of Patent: May 10, 1994

[54] TAPE DISPENSER

[75] Inventor: William E. Tucker, Attleboro, Mass.

[73] Assignee: The Gillette Company, Boston, Mass.

[21] Appl. No.: 961,428

[22] Filed: Oct. 15, 1992

[51] Int. Cl.[5] ..... B32B 31/00

[52] U.S. Cl. ..... 156/574; 156/577; 156/579; 156/584

[58] Field of Search ..... 156/574, 577, 579, 523, 156/527, 540, 584

[56] References Cited

U.S. PATENT DOCUMENTS

| | | | |
|---|---|---|---|
| Re. 32,010 | 10/1985 | Collins | 156/577 |
| D. 214,405 | 6/1969 | Fleming | D74/1 |
| D. 238,360 | 1/1976 | Gibbs | D19/69 |
| D. 298,339 | 11/1988 | Eisenberg | D19/67 |
| D. 310,846 | 9/1990 | Sakurai | D19/69 |
| 3,839,127 | 10/1974 | Hazuka et al. | 156/540 |
| 3,850,779 | 11/1974 | Pearson | 156/523 |
| 3,902,956 | 9/1975 | Thompson, Jr. | 156/523 |
| 3,930,697 | 1/1976 | Barouh et al. | 312/39 |
| 4,220,495 | 9/1980 | Uchida | 156/577 |
| 4,336,097 | 6/1982 | Van Kampen et al. | 156/527 |
| 4,591,407 | 5/1986 | Samuelson | 156/527 |
| 4,676,861 | 6/1987 | Bishop | 156/527 |
| 4,704,185 | 11/1987 | Fischer | 156/577 |
| 4,718,971 | 1/1988 | Summers | 156/577 |
| 4,772,355 | 9/1988 | Leahy | 156/584 |
| 4,824,517 | 4/1989 | Leahy | 156/584 |
| 4,849,064 | 7/1989 | Manusch et al. | 156/577 |
| 4,851,076 | 7/1989 | Manusch et al. | 156/577 |
| 4,853,074 | 8/1989 | Manusch et al. | 156/577 |
| 4,997,512 | 3/1991 | Manusch | 156/486 |
| 5,000,815 | 3/1991 | Hanna | 156/542 |
| 5,006,184 | 4/1991 | Manusch et al. | 156/577 |
| 5,125,589 | 6/1992 | Manusch | 242/67.30 R |
| 5,150,851 | 9/1992 | Manusch et al. | 242/68.1 |
| 5,178,717 | 1/1993 | Rodriguez | 156/577 |

FOREIGN PATENT DOCUMENTS

| | | | |
|---|---|---|---|
| 2114951 | 9/1983 | United Kingdom | B65H 49/18 |

*Primary Examiner*—David A. Simmons
*Assistant Examiner*—William J. Matney, Jr.
*Attorney, Agent, or Firm*—Owen J. Meegan; Aubrey C. Brine; Donal B. Tobin

[57] ABSTRACT

A hand operated device for transferring an adhesive film from a carrier tape to a substrate is provided with a feed spool containing the carrier tape, and a take-up spool mounted in a housing. The carrier tape is fed from the feed spool to the take-up spool over an applicator bar and the take-up spool is driven by the feed spool through a clutch plate to maintain a degree of tension in the carrier tape during operation of the device.

14 Claims, 5 Drawing Sheets

TAPE DISPENSER

BACKGROUND OF THE INVENTION

The present invention relates to a device for applying a correction film to a substrate surface and more particularly to a hand operated device for transferring a film from a carrier tape to a substrate such as paper.

The prior art has provided devices that are designed to apply an adhesive film to a surface, the film generally being provided on a carrier tape and further being of the type which adheres to the substrate surface when pressure is applied against the tape at the substrate surface. Typical of such devices are those disclosed in U.S. Pat. Nos. 4,849,064, 4,851,076, and 4,853,074 each issued in the name of Manusch et al.

In general these devices are formed of a housing having a feed reel or spool containing a carrier tape which is mounted within the housing and a reel for accepting the tape after usage, the tape being fed over an applicator member which extends from the housing and is generally disposed on a spring support of some type. The device is held in the hand of the user who applies the applicator to the substrate and exerts that pressure sufficient to press the tape against the substrate for transfer of the film to the substrate.

While these devices have proved to be adequate, many require a plurality of elements in order to maintain the tension in the tape during the feeding process and therefore require a number of operations in their assembly. The cost for the various elements as well as the time of assembly is most noticeable when the device is that which is employed for a single roll of film and then discarded.

It is therefore and object of the present invention to provide a hand operated device for transferring a film from a carrier tape to a substrate in which a minimum number of elements are employed, thereby requiring a minimum time for assembly.

A further object of the invention is to provide a device of the type set forth above which is simple to operate and reliable in operation.

Yet another object of the invention is to provide a hand operated device of the type under consideration which is simple to construct and therefore economical to manufacture.

SUMMARY OF THE INVENTION

The above objects and other objectives which will become apparent as the description proceeds are accomplished by providing a hand operated device for transferring film from a carrier tape to a substrate comprising wall structure forming a housing having an applicator means and containing a carrier tape disposed on a feed spool axially mounted for rotation. A take-up spool is rotatably mounted for receiving tape from the feed spool after having passed over the applicator means. A clutch plate is disposed for rotation about a common axis with the feed spool and contacts the take-up spool for rotating the take-up spool when the clutch plate is rotated. Biasing means is provided for forcing the clutch plate into contact with the feed spool. Movement of the tape between the applicator means and the substrate is effective to cause rotation of the feed spool and the clutch plate through frictional contact between the tape and substrate thereby rotating the take-up spool, and a predetermined tensile force in the tape is effective to cause slippage between the feed spool and the clutch plate.

Generally the take-up spool is provided with a plurality of gear teeth disposed about the periphery of the spool and the clutch plate is provided with a plurality of gear teeth about the periphery thereof such that contact between the clutch plate and the take-up spool occurs through meshing of the gear teeth.

The facing surfaces of the feed spool and the clutch plate are generally formed such that one surface comprises a ring of abutting nodules extending toward an opposite facing surface and the other surface comprises a ring of abutting v-shaped indentations for receiving the nodules therein to provide contact between the clutch plate and the feed spool.

In the present device it is preferable that the ring of abutting nodules be formed on the feed spool and the ring of abutting v-shaped indentations are formed on the clutch plate, although it may be preferable in other structures to have the arrangement reversed.

BRIEF DESCRIPTION OF THE DRAWING

Reference is made to the accompanying drawing in which there is shown an illustrative embodiment of the invention from which its novel features and advantages will become apparent, wherein.

DESCRIPTION OF THE PREFERRED EMBODIMENT

Figure 1:
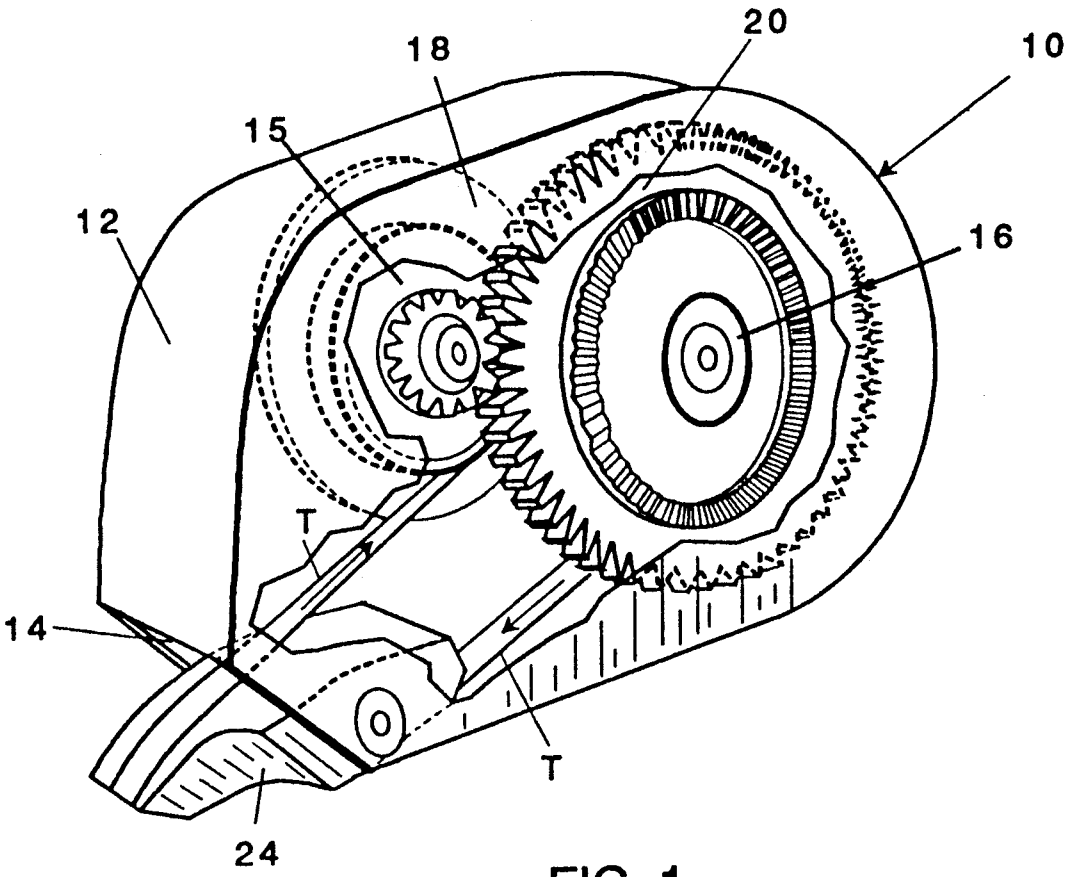
FIG. 1 is a left front perspective view showing a tape dispenser constructed in accordance with the teachings of the present invention, having portions of the housing removed to show the operative elements more clearly.
Figure 8:
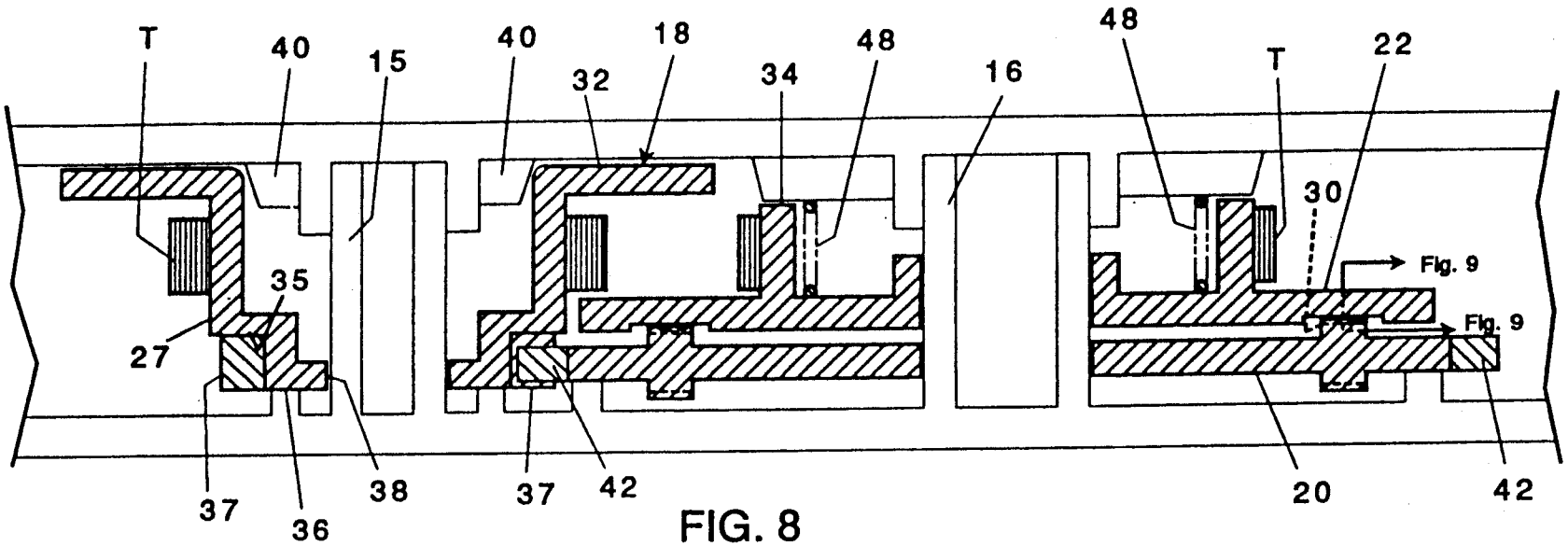
FIG. 8 is a partial sectional view taken along the axes of the elements shown is FIGS. 2 through 7 when embodied in the structure shown in FIG. 1.

Referring now to the drawing and in particular to FIG. 1 there is shown a hand operated device 10 for transferring a film from carrier tape to a substrate which comprises a housing 12 formed of wall structure which substantially encloses the housing with the exception of an opening 14 formed in the forward end of the housing. As best shown in FIG. 8, the wall structure of the housing is interconnected by a pair of tubular elements 15 and 16, the element 15 serving as an axle upon which a take-up spool 18 is mounted for rotation and the element 16 serving as a shaft upon which a clutch plate 20 and a feed spool 22 are mounted for rotation.

The feed spool 22 carries a roll of carrier tape T bearing an adhesive film which is applied to the substrate after which it is wound upon the take-up spool 18 as shown in FIGS. 1 and 8.

After passing from the feed spool 22 the tape T is directed over an applicator 24 pivotally mounted in the opening 14 for contact with a substrate onto which the adhesive film on the tape T is to be applied. While the applicator 24 is shown to be simple in form, it should be understood that an applicator of any type may be employed, such as those devices shown in the prior art referred to above. The various forms which the applicator means may take will therefore not be discussed in detail, as it may be of any type which allows the user to apply pressure between the tape T and the substrate of sufficient magnitude to apply the adhesive film to the substrate.

Figure 2:
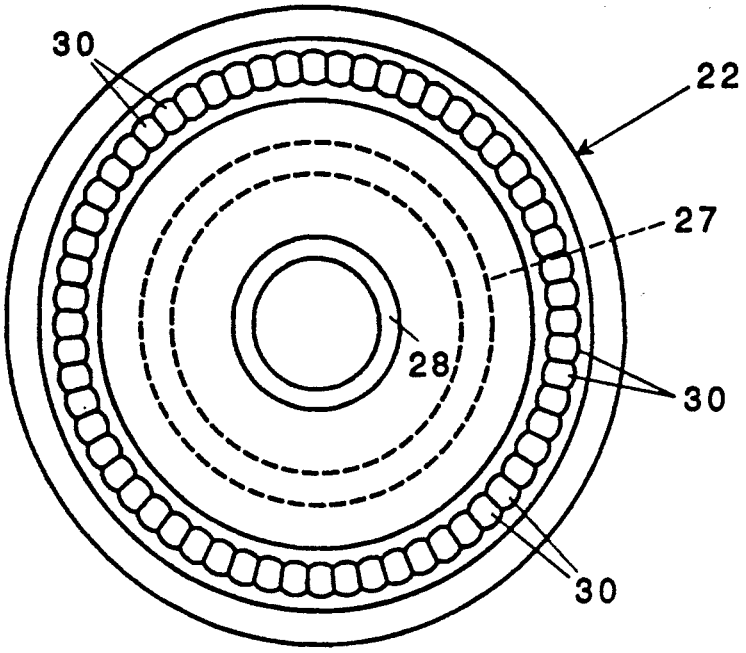
FIG. 2 is a front elevational view showing the drive face of a feed spool employed in the device of FIG. 1.
Figure 3:
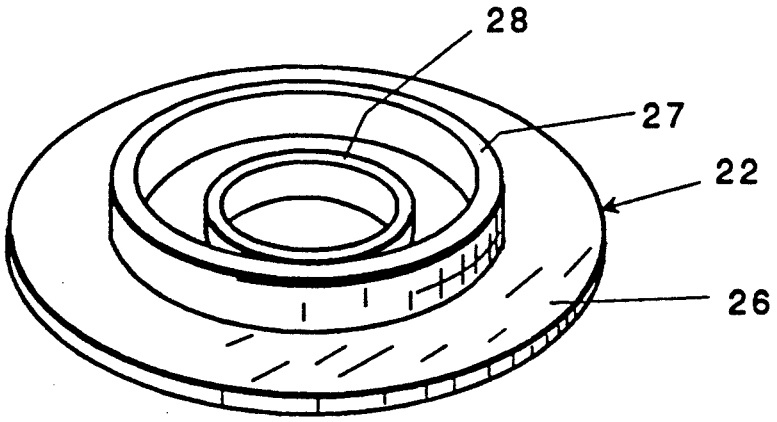
FIG. 3 is a rear perspective view showing further details of the feed spool of FIG. 2.
Figure 9:
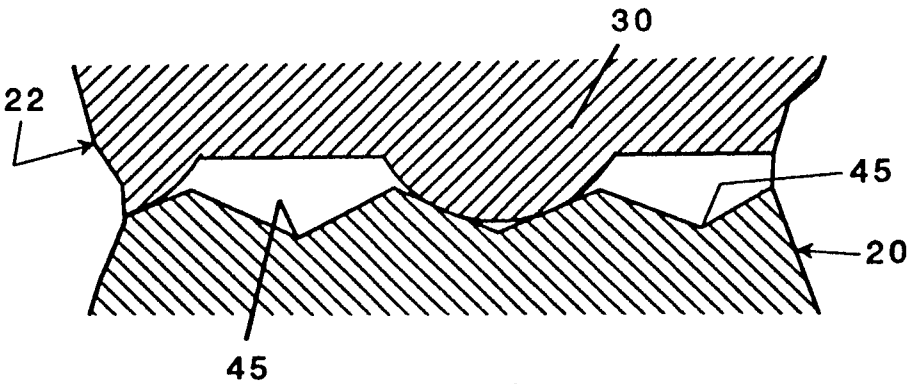
FIG. 9 is a section taken along the line IX—IX of FIG. 8 showing the interface between the clutch plate of FIGS. 6 and 7 and the feed spool of FIGS. 2 and 3, taken on an enlarged scale for clarity.

Referring now to FIGS. 2 and 3, the feed spool 22 is shown to comprise a disc 26 having on its one surface a tubular reel 27 and a bearing 28 for mounting of the feed spool onto the tubular element 16. The opposite surface of the disc 26 has formed thereon a ring of abutting nodules 30 which are arranged equally spaced from the axis of the feed spool 22. The nodules 30 are formed to have an outwardly projecting radial surface which is best shown in FIG. 9.

While in the preferred embodiment the nodules 30 are shown arranged in a continuous ring, it should be understood that the spacing of the nodules may be such that every other one, or two etc., may be eliminated, and as few as 3 nodules, properly spaced about the circle, would be effective to achieve the desired result.

Figure 4:
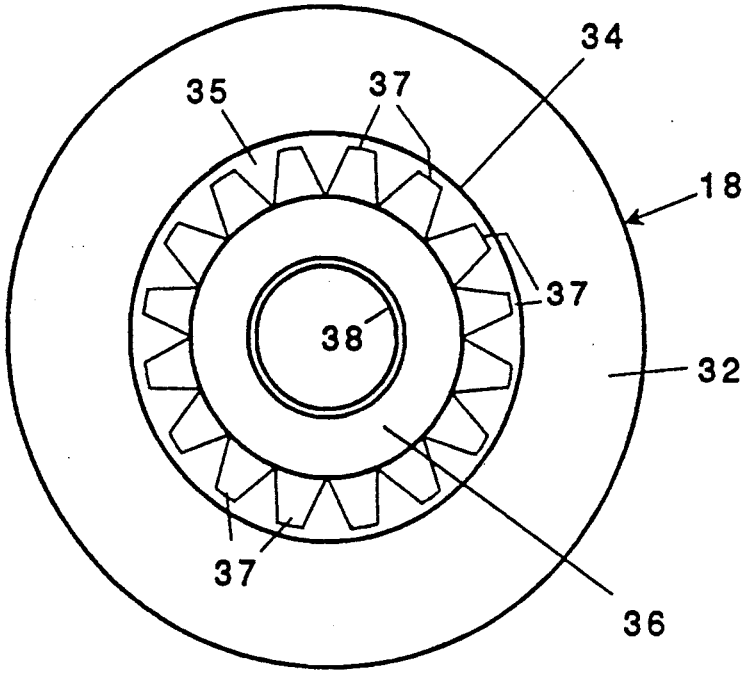
FIG. 4 is a front elevational view showing details of the take-up spool of the device shown in FIG. 1.
Figure 5:
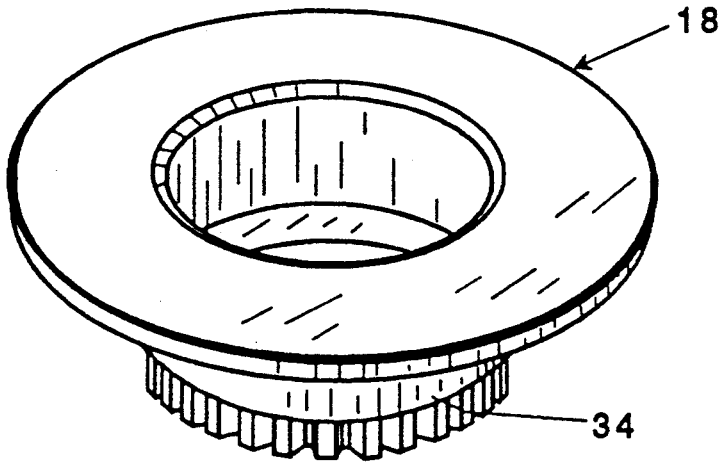
FIG. 5 is a rear perspective view showing the opposite face of the take-up spool of FIG. 4.

Referring now to FIGS. 4 and 5, the take-up spool 18 is formed of a disc 32 having an outwardly extending tubular reel 34 on which the tape T is wound, the tape not being shown at FIGS. 4 and 5 for purposes of describing the structural elements of the feed spool 18. The tubular reel 34 terminates at its outermost end in a shoulder 35 on which a gear 36 is formed. The gear 36 comprises a plurality of gear teeth 37 and has a bearing surface 38 which is mounted on the tubular element 15 for rotation, as best shown in FIG. 8. In addition to the rotational support provided by the mounting of the bearing surface 38 onto the tubular element 15 the disc 32 is further supported by a plurality of support ribs 40 which contact the inner surface of the disc 32.

Figure 6:
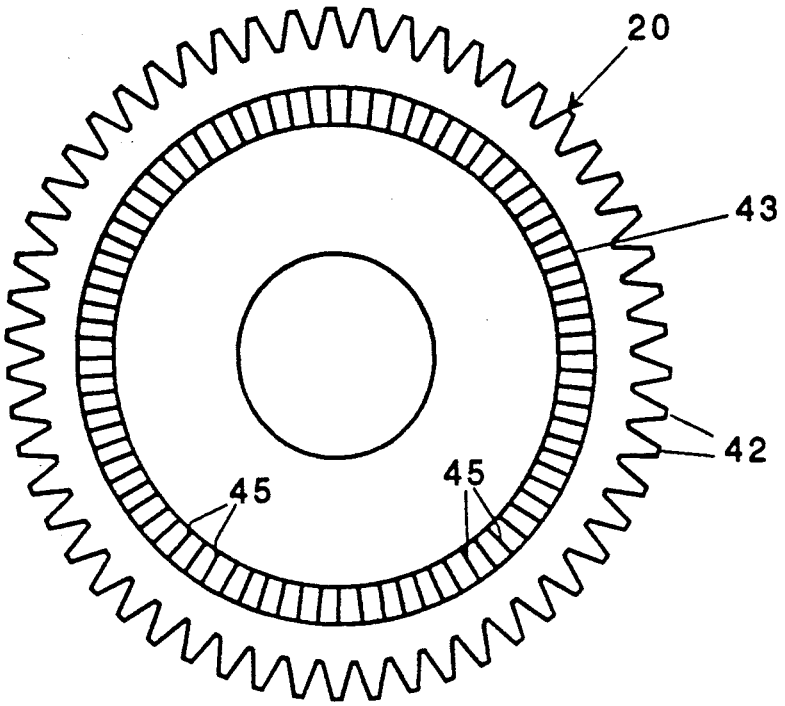
FIG. 6 is a front elevational view showing details of a clutch plate employed in the device shown in FIG. 1.
Figure 7:
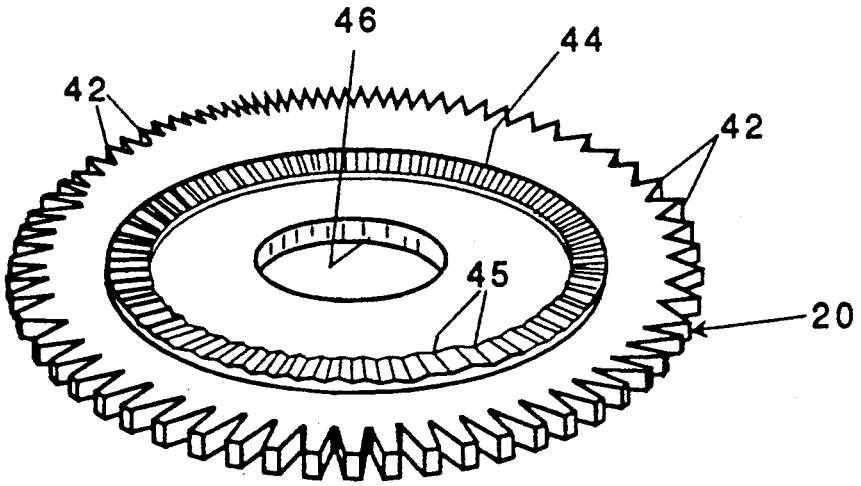
FIG. 7 is a rear perspective view of the clutch plate of FIG. 6 showing the opposite face of the clutch plate of FIG. 6.

The clutch plate 20 is shown at FIGS. 6 and 7 to comprise a plurality of gear teeth 42 formed on its periphery which are designed to drivingly engage the gear teeth 37 on the take-up spool 18. As will be observed, on either side of the clutch plate 20 there is formed a ring 43 and 44 respectively each having a plurality of v-shaped indentations 45 the rings 43 and 44 being of the same diameter as the array of nodules 30 disposed on the surface of the feed spool 22. A bearing surface 46 is formed about the axis of the clutch plate 20 for mounting the clutch plate onto the tubular element 16 as shown in FIG. 8.

While the clutch plate 20 is shown to have rings 43 and 44 of adjacent v-shaped indentations 45 it should be noted that only one such ring of v-shaped indentations is necessary to perform the function of the clutch plate. However, by providing identical facing surfaces to the clutch plate 20 the possibility of error in mounting the clutch plate with the proper face in position is eliminated.

In operation, with the feed spool 22, the clutch plate 20 and the take-up spool is mounted as shown in FIGS. 1 and 8 and described above, when it is desirable to transfer the film from the carrier tape T to a substrate, the applicator 24 is applied to the substrate with sufficient pressure and the device 10 is moved rearwardly causing the tape T to unwind from the feed spool 22 onto the tubular reel 34 of the take-up spool 18. Rotation of the feed spool 22 caused by tension in the tape is effective to rotate the clutch plate 20 by virtue of the mating of the nodules 30 on the feed spool with the indentations 45 on the clutch plate.

As is evident from FIG. 8, the circumference upon which the gear teeth 37 are formed is substantially less than the circumference of the clutch plate 20 upon which the gear teeth 42 are formed. Therefore, when the feed spool 22, and the clutch plate 20 are rotated, the rotation is effective to rotate the clutch plate 20 the periphery of which through meshing of the gears teeth 37 and 42 causes the take-up spool 18 to move at a much higher rotational speed than the feed spool 22. By virtue of this difference in rotational speed, the tape T is kept taut at all times and slippage occurs between the nodules 30 and the v-shaped indentations 45 to prevent breakage of the tape.

As best shown in FIGS. 8 and 9, the nodules 30 formed on the feed spool 22 are formed to fit snugly in the v-shaped indentations 45 of the clutch plate and a helical spring 48 maintains a pressure against the feed spool 22 of sufficient force to provide that force necessary to cause movement of the clutch plate 20 when the clutch action is required to maintain tape tensile load.

A simple structure is therefore provided which includes a minimum number of elements to perform the transferring of the film from a carrier tape T to the substrate.

While it is apparent that changes and modifications can be made within the spirit and scope of the present invention, it is my intention, however, only to be limited by the appended claims.

As my invention I claim:

1. A hand operated device for transferring a film from a carrier tape to a substrate comprising wall structure forming a housing having an applicator means and containing a carrier tape disposed on a feed spool axially mounted for rotation and having a face surface;

a take-up spool rotatably mounted for receiving tape from said feed spool after having passed over said applicator means, a clutch plate having a face surface controlling said feed spool face surface and disposed for rotation about a common axis with said feed spool, said clutch plate face surface contacting said take-up spool face surface for rotating said take-up spool upon rotation of said clutch plate; and biasing means for forcing said face surface of said clutch plate into contact with said face surface of said feed spool;

whereby tape moved over said applicator means is effective to cause rotation of said feed spool and said clutch plate through frictional contact therebetween to thereby rotate said take-up spool, and a predetermined tensile force in said tape is effective to cause slippage between said feed spool and said clutch plate.

2. A device as set forth in claim 1 wherein said take-up spool is provided with a plurality of gear teeth disposed about the periphery thereof and said clutch plate is provided with a plurality of gear teeth disposed about the periphery thereof and said contact between said clutch plate and said take-up spool occurs through meshing of said gear teeth.

3. A device as set forth in claim 1 wherein one of said face surfaces comprises a ring of abutting nodules extending toward an opposite facing surface and the other of said face surfaces comprises a ring of abutting v-shaped indentations for receiving said nodules therein to provide said contact between said clutch plate and said feed spool face surfaces.

4. A device as set forth in claim 3 wherein said ring of abutting nodules is formed on said feed spool and said ring of abutting v-shaped indentations is formed on said clutch plate.

5. A device as set forth in claim 1 wherein said biasing means comprises a spring disposed between a wall of said housing and said clutch plate.

6. A device as set forth in claim 1 wherein said take-up spool is of a lesser diameter than said feed spool.

7. A device as set forth in claim 1 wherein said take-up spool is of a lesser diameter than said clutch plate.

8. A device as set forth in claim 1 wherein each said housing, said feed spool, said take-up spool and said clutch plate are manufactured of a rigid plastic material.

9. A device as set forth in claim 2 wherein one of said face surfaces comprises a ring of abutting nodules extending toward an opposite facing surface and the other of said face surfaces comprises a ring of abutting v-shaped indentations for receiving said nodules therein to provide said contact between said clutch plate and said feed spool.

10. A device as set forth in claim 2 wherein said ring of abutting nodules is formed on said feed spool and said ring of abutting v-shaped indentations is formed on said clutch plate.

11. A device as set forth in claim 10 wherein said biasing means comprises a spring disposed between a wall of said housing and said clutch plate.

12. A device as set forth in claim 11 wherein said take-up spool is of a lesser diameter than said feed spool.

13. A device as set forth in claim 12 wherein said take-up spool is of a lesser diameter than said clutch plate.

14. A device as set forth in claim 13 wherein each said housing, said feed spool, said take-up spool and said clutch are manufactured of a rigid plastic material.

* * * * *